US007031626B1

(12) United States Patent
Stelter et al.

(10) Patent No.: US 7,031,626 B1
(45) Date of Patent: Apr. 18, 2006

(54) FIXING ROLLER SYSTEM AND METHOD

(75) Inventors: Eric C. Stelter, Pittsford, NY (US); John R. Thompson, Las Vegas, NV (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/807,964

(22) Filed: Mar. 24, 2004

Related U.S. Application Data

(60) Provisional application No. 60/458,848, filed on Mar. 28, 2003.

(51) Int. Cl.
*G03G 15/20* (2006.01)
*F28F 5/02* (2006.01)

(52) U.S. Cl. ..... 399/45; 399/69; 399/334; 492/46

(58) Field of Classification Search ..... 399/45, 399/67, 68, 69, 328, 330, 334, 335; 347/156; 100/334, 335, 336; 492/46; 101/424.1, 101/487, 488; 432/60; 219/469
See application file for complete search history.

(56) References Cited

U.S. PATENT DOCUMENTS

| | | | | |
|---|---|---|---|---|
| 4,199,626 | A | 4/1980 | Stryjewski et al. | |
| 4,252,184 | A * | 2/1981 | Appel | 165/90 |
| 4,282,638 | A * | 8/1981 | Christ et al. | 492/7 |
| 4,585,325 | A * | 4/1986 | Euler | 399/69 |
| 4,729,153 | A * | 3/1988 | Pav et al. | 492/7 |
| 4,757,582 | A * | 7/1988 | Verkasalo | 492/7 |
| 5,140,377 | A * | 8/1992 | Lewis et al. | 399/335 |
| 5,300,996 | A * | 4/1994 | Yokoyama et al. | 399/69 |
| 5,819,150 | A * | 10/1998 | Hayasaki et al. | 399/330 |
| 5,881,349 | A * | 3/1999 | Nanataki et al. | 399/328 |
| 5,893,018 | A | 4/1999 | De Bock et al. | |
| 5,895,598 | A * | 4/1999 | Kitano et al. | 219/619 |
| 5,970,301 | A | 10/1999 | De Cock | |
| 6,067,437 | A * | 5/2000 | Schonfeld | 399/320 |
| 6,087,641 | A * | 7/2000 | Kinouchi et al. | 219/619 |
| 6,185,383 | B1 * | 2/2001 | Kanari et al. | 399/45 |
| 6,271,870 | B1 * | 8/2001 | Jacob et al. | 347/156 |
| 6,285,850 | B1 | 9/2001 | Van Weverberg et al. | |
| 6,289,797 | B1 * | 9/2001 | Ijas | 100/38 |
| 6,333,490 | B1 * | 12/2001 | Higashi et al. | 219/216 |
| 6,368,458 | B1 * | 4/2002 | Graf et al. | 162/206 |
| 6,389,241 | B1 * | 5/2002 | Cernusak et al. | 399/44 |
| 6,529,693 | B1 * | 3/2003 | Tomizawa et al. | 399/44 |
| 6,605,802 | B1 * | 8/2003 | Nagahira | 219/619 |
| 6,871,039 | B1 * | 3/2005 | Murata | 399/323 |
| 2003/0103789 | A1 * | 6/2003 | Boss | 399/330 |

* cited by examiner

*Primary Examiner*—R. Alexander Smith
(74) *Attorney, Agent, or Firm*—Donna P. Suchy

(57) ABSTRACT

The invention relates to the use of roller fusing in printing. In particular, the invention relates to the use of heated rollers. According to one aspect of the invention, a fixing process and system for use with a printing apparatus is provided wherein a flow of heat exchange medium through a first heating zone within a fixing roller and a second heating zone within the fixing roller is controlled, and marking material is fixed to a receiver with the fixing roller. According to another aspect of the invention, a fixing process and system for use with a printing apparatus is provided wherein marking material is fixed to a receiver with a fixing roller and wherein a heat exchange medium is flowed through a first heating zone within the fixing roller, the first heating zone being biased toward the receiver.

27 Claims, 3 Drawing Sheets

FIXING ROLLER SYSTEM AND METHOD

This application claims the benefit of U.S. Provisional Application Ser. No. 60/458,848 filed Mar. 28, 2003.

BACKGROUND

The invention relates to the use of roller fixing in printing. In particular, the invention relates to the use of heated rollers.

Roller fusing is used for both ink jet and toner images. For example, roller fusing is often used to fix electrophotograpic or ionographic toner images onto a receiver. Both heat and pressure are required. Roller fusing has also been used with ink jet images and is applicable to powder coatings. For all printing methods, increased heat flow from the fuser can be used to increase process speeds, and improved heat flow may be necessary for printing on thermally conductive substrates. Temperature uniformity where the fuser roller contacts the receiver is preferred and is difficult to obtain with conventional hollow, air filled fuser rollers heated internally by quartz lamps or other electrical resistance heaters.

For label printing, hot foil embossing is done with a heated cylinder that has a closed hot oil circulation system. Foil is embossed onto the web under the influence of heat and pressure. Advantages include quick heating of the cylinder and small temperature fluctuations.

During the manufacturing process for paper, rollers heated by steam are used to dry the paper.

DETAILED DESCRIPTION

Figure 1:
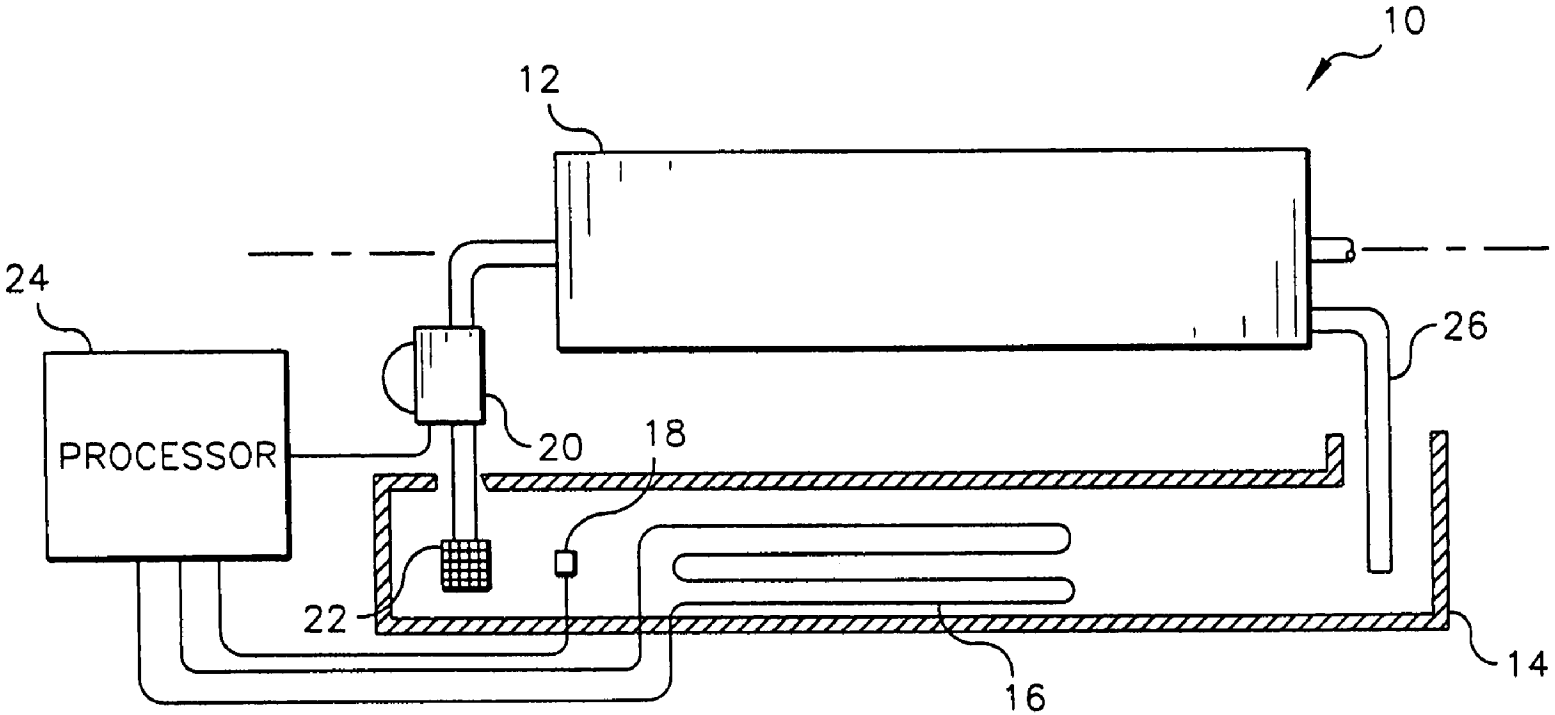
FIG. 1 is a schematic partial cutaway view of a fixing system for use in printing.

In a printing apparatus, a fixing system 10 is provided with a fixing roller 12. The fixing roller 12 is heated by a recirculating fluid heat exchange medium from a reservoir 14. This heat exchange medium may be oil, water, steam, ethylene glycol, or other heated liquids, gasses, or phase change materials The heat exchange fluid in the reservoir 14 is heated by a heater 16, which may be, for example, an electrical resistance heater, heat exchanger, or other heating apparatus. The heater may likewise be disposed inside the fusing roller 12.

A temperature monitor 18 monitors the temperature of the heat exchange medium. A pump 20 draws the heat exchange fluid through an intake 22 and provides the heated medium to the fusing roller 12. After circulating through the fusing roller 12, the heat exchange fluid is released through one or more return tubes 26 back into the reservoir 14.

The operation of the pump 20 and the heater 16 may be controlled by a controller 24, such as a processor, which may include a general purpose computer operated by software or a special-purpose computer or logic circuit designed to operate the fixing system 10. The controller 24 may be a control unit implemented to operate an entire printing system, including the fixing system 10. In an alternative embodiment, the control unit is a simple thermostat designed to maintain the temperature of the heat exchange fluid in the reservoir 14. The controller 24 preferably maintains the temperature of the heat exchange fluid at a temperature setpoint or within a temperature range.

The reservoir 14 may take a variety of forms such as an unsealed sump as illustrated in FIG. 1, a sealed boiler, a coil of tubes, or other arrangement selected to complement the choice of heat exchange fluid and type of heater 16 selected.

Figure 2:
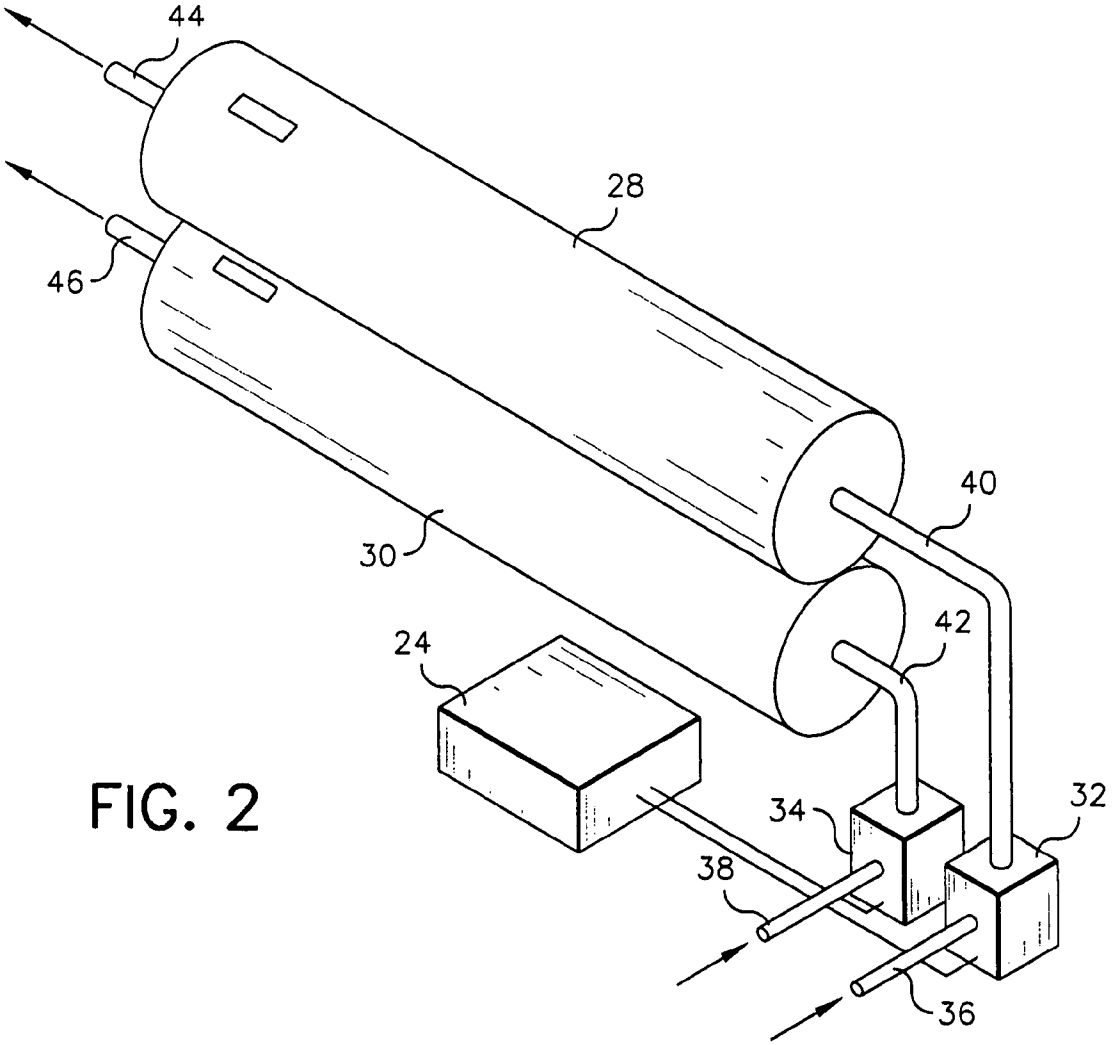
FIG. 2 is a schematic perspective view illustrating two heated fixing rollers in a fixing system.

As illustrated in FIG. 2, two fixing rollers 28, 30 may be used together to provide heat to a receiver, such as a sheet of paper, on which an image has been printed. Separate pumps 32, 34 may be provided for each respective roller 28, 30 to pump the heat exchange fluid to and through the fixing rollers. Alternatively, a single pump may be employed, with fluid distribution to the rollers 28, 30 being accomplished by valves or other means. The heat exchange fluid supplied to the rollers 28, 30 is drawn through intake tubes 36, 38 that preferably are supplied from the same reservoir (such as the reservoir 14 of FIG. 1) to limit the temperature differential between the two fusing rollers 28, 30. The controller 24 may operate the pumps 32, 34. Although the pumps are illustrated as being positioned on the supply side of the rollers, it should be noted that the pumps may be positioned on the return side of the rollers.

In a method of operating a fixing system, a receiver 66 on which text and/or images have been printed by, for example, inkjet, electrographic, or other means is passed between the fixing rollers 28, 30 to fix the marking material (for example ink, dye, and/or toner) applied to the receiver. This may involve fusing, in the case of toner or another fusible material. The fixing rollers 28, 30 are maintained at a selected temperature or within a selected temperature range by heat from a heat exchange fluid pumped through tubes 40, 42 to the fixing rollers 28, 30. After flowing through the fixing rollers 28, 30, the heat exchange fluid exits the rollers through return tubes 44, 46 to be returned to the reservoir (not illustrated in FIG. 2) and reheated.

A heat load required of the fixing system 10 may vary depending upon a variety of parameters, including a speed at which receivers 66 are passed through the fixing system 10, the type of receiver 66 passed through the fixing system 10, and the type of marking material passed through the fixing system 10. Therefore, according to a further aspect of the invention, the fixing system 10 may be controlled while taking these factors into account. For example, the flow rate of the heat exchange medium may be controlled to be proportional to a speed at which receivers 66 are passed through the fixing system 10. According to a further example, certain receivers may require more heat energy for proper fixing than others, and a temperature of the heat exchange medium may be controlled dependent upon a type of receiver 66 passed through the fixing system 10 so that more or less heat energy is available, as needed. Furthermore, certain marking material may require more heat energy for proper fixing than others, and a temperature of the heat exchange medium may be controlled dependent upon a type of marking material passed through the fixing system 10 so that more or less heat energy is available, as needed. These control concepts may be implemented alone, in combination with one or more of the others, or with other fixing system control parameters.

Figure 3:
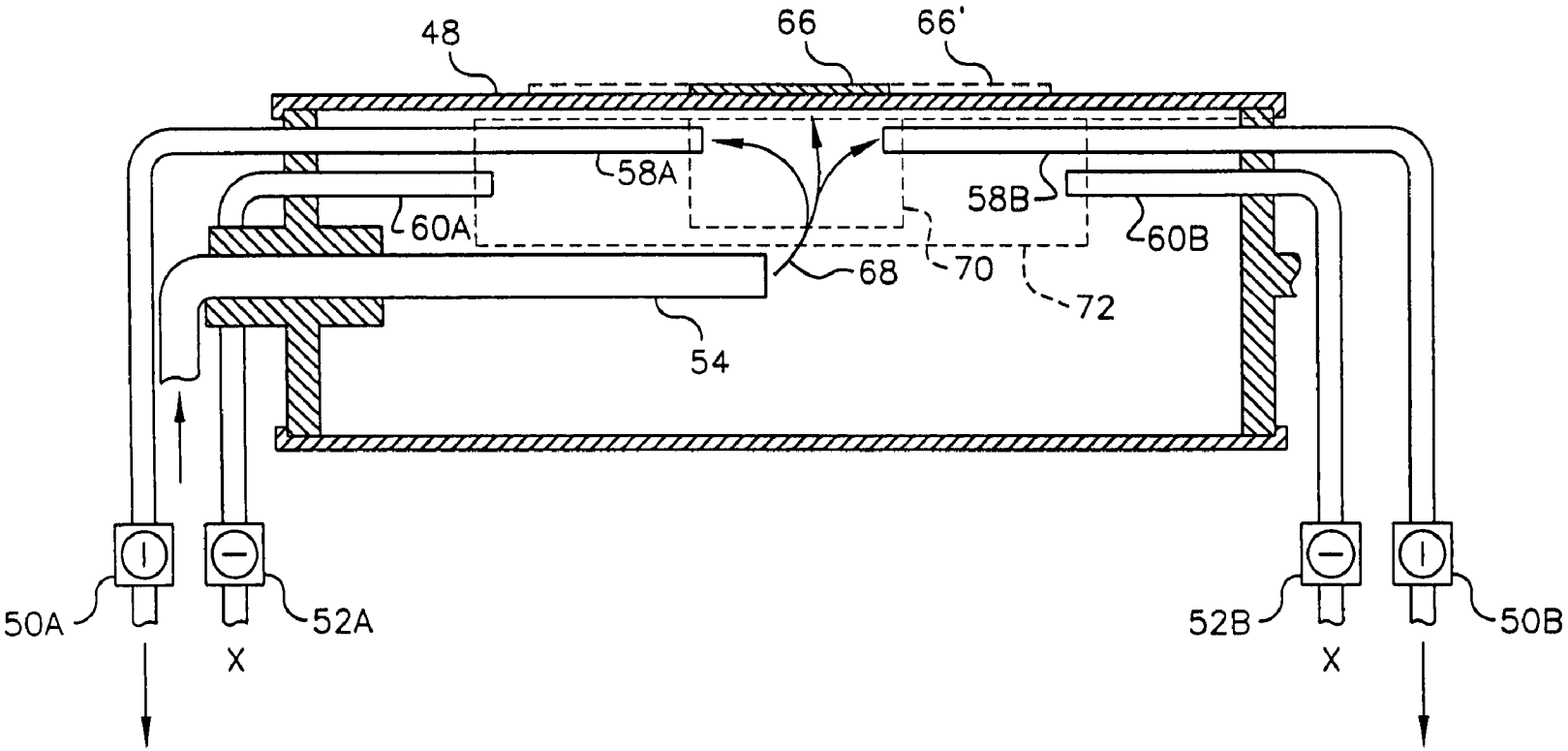
FIG. 3 is a schematic partial cutaway view of a fixing roller with selectable heating zones.

As illustrated in FIG. 3, a fixing system for use with a printing apparatus is provided, comprising a fixing roller 48 operative to fix marking material to a receiver 66, and a first heating zone 70 within the fixing roller 48 biased toward the receiver 66. For example, the fixing roller 48 has an axis of rotation and the first heating zone is displaced toward the receiver 66 away from the axis of rotation. At least a second heating zone 72 may be provided within the fixing roller biased toward the receiver 66. This allows a variable heating zone to be selected so that portions nearest to a receiver 66 are selectively heated. The heat exchange fluid, such as hot oil, may be supplied in the center of the roller 48 through a fluid supply tube 54. Narrow-zone return tubes 58*a*, 58*b* and wide-zone return tubes 60*a*, 60*b* are positioned within the roller 48. Flow through the narrow-zone return tubes 58*a*, 58*b* is controlled respectively by the valves 50*a*, 50*b*. Flow through the wide-zone return tubes 60*a*, 60*b* is controlled respectively by the valves 52*a*, 52*b*. The valves 50*a*, 50*b*, 52*a*, 52*b* may be operated manually or they may be operated automatically by the controller 24 (FIG. 1).

The flow of heat exchange medium may be controlled as a function of a width of the receiver 66. The first heating zone 70 and second heating zone 72 may correspond to different width receivers.

In an exemplary use of the roller 48 in a fusing system, the valves 52*a,b* are closed, while the valves 50*a,b* are open, so that heat exchange fluid flows from the supply tube 54 to the narrow-zone return tubes 58*a*, 58*b*. The arrows 68 provide a simplified illustration of the path of heat exchange fluid flow. The fluid flows primarily over a narrow zone of the roller 48 nearest the receiver 66. If a larger receiver is used, such as the receiver 66', the valves 50*a,b* may be closed, and the valves 60*a,b* may be opened to enable heat exchange fluid to flow over the entire zone of the roller 48 that is adjacent to the larger receiver 66'.

In alternative embodiments, the roles of the return tubes and the supply tube may be reversed to reverse fluid flow while allowing for a selectable zone of heating, or the return tubes may be positionable within the roller 48 to provide for adjustments of the heating zone size. Additional return tubes may also be provided at different locations within the fuser roller 48.

Circulation, convection, and thermal conductivity of the heat exchange medium in a fuser contributes to the ability to control the temperature of the fuser roll, to provide uniform temperature across the fuser, and to promote heat flow. With a circulating liquid or phase change material, relatively thin walled tubing can be used for the fuser and temperature uniformity is promoted by circulation in the roller adjacent the receiver. The thin wall of the roller further promotes heat flow from the medium to the receiver. If a phase change material such as steam is used as the heat exchange fluid, heat is released during condensation on the cooler areas of the roller, providing good heat up times, temperature uniformity, and heat flow for areas on the roller surface that, for example, are conducting heat to the receiver. If phase change materials are used, the return tubes may be provided with one or more collection tubes to collect liquid from the inside of the fuser roller. For example, the fuser roller may be provided with grooves running circumferentially on the inner surface of the roller, with collection tubes in each groove.

A controller and supporting software are implemented to control the various functions described herein. Such implementation is well within ordinary skill in the relevant art. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. The control implementation may be expressed in software, hardware, and/or firmware.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof. The claims should not be read as limited to the described order or elements unless stated to that effect. In addition, use of the term "means" in any claim is intended to invoke 35 U.S.C. §112, paragraph 6, and any claim without the word "means" is not so intended.

What is claimed is:

1. A fixing system for use with a printing apparatus, comprising:

a fixing roller;

at least a first heating zone and a second heating zone defined within the fixing roller; and, a controller operative to control a flow of heat exchange medium through the first heating zone and through the second heating zone.

2. The fixing system of claim 1, comprising at least one supply tube that supplies heat exchange medium to the fixing roller;

the first heating zone comprising at least two first-zone return tubes;

the second heating zone comprising and at least two second-zone return tubes; and the controller being operative to select flow through either the first-zone return tubes or the second-zone return tubes.

3. The fixing system of claim 1, comprising at least one return tube that returns heat exchange medium from the fixing roller;

the first heating zone comprising at least two first-zone supply tubes;

the second heating zone comprising and at least two second-zone supply tubes; and the controller being operative to select flow through either the first-zone supply tubes or the second-zone supply tubes.

4. The fixing system of claim 1, the controller comprising a valve.

5. The fixing system of claim 1, the controller comprising a pump.

6. The fixing system of claim 1, the controller being operative to control flow rate of the heat exchange medium proportional to a speed at which receivers are passed through the fixing system.

7. The fixing system of claim 1, the controller being operative to control a temperature of the heat exchange medium dependent upon a type of receiver passed through the fixing system.

8. The fixing system of claim 1, the controller being operative to control a temperature of the heat exchange medium dependent upon a type of marking material passed through the fixing system.

9. A fixing process for use with a printing apparatus, comprising:

controlling a flow of heat exchange medium through a first heating zone within a fixing roller and a second heating zone within the fixing roller; and, fixing marking material to a receiver with the fixing roller.

10. The fixing process of claim 9, comprising controlling the flow of heat exchange medium as a function of a width of the receiver.

11. The fixing process of claim 9, comprising controlling the flow of heat exchange medium as a function of a width of the receiver, the first heating zone and second heating zone corresponding to different width receivers.

12. The fixing process of claim 9, comprising controlling flow rate of the heat exchange medium proportional to a speed at which receivers are passed through the fixing system.

13. The fixing process of claim 9, comprising controlling a temperature of the heat exchange medium dependent upon a type of receiver passed through the fixing system.

14. The fixing process of claim 9, comprising controlling a temperature of the heat exchange medium dependent upon a type of marking material passed through the fixing system.

15. A fixing process for use with a printing apparatus, comprising:

fixing marking material to a receiver with a fixing roller;

flowing a heat exchange medium through a first heating zone within the fixing roller, the first heating zone being biased toward the receiver.

16. The fixing process of claim 15, comprising:

flowing the heat exchange medium through a second heating zone within the fixing roller, the second heating zone being biased toward the receiver.

17. The fixing process of claim 16, comprising controlling a flow of heat exchange medium as a function of a width of the receiver.

18. The fixing process of claim 16, comprising controlling a flow of heat exchange medium as a function of a width of the receiver, the first heating zone and second heating zone corresponding to different width receivers.

19. The fixing process of claim 15, comprising controlling a flow of the heat exchange medium proportional to a speed at which receivers are passed through the fixing system.

20. The fixing process of claim 15, comprising controlling a temperature of the heat exchange medium dependent upon a type of receiver passed through the fixing system.

21. The fixing process of claim 15, comprising controlling a temperature of the heat exchange medium dependent upon a type of marking material passed through the fixing system.

22. A fixing system for use with a printing apparatus, comprising:

a fixing roller operative to fix marking material to a receiver, the fixing roller having a flow of heat exchange medium; and, a first heating zone within the fixing roller biased toward the receiver.

23. The fixing system of claim 22, comprising:

at least a second heating zone within the fixing roller biased toward the receiver.

24. The fixing system of claim 22, comprising:

at least a second heating zone within the fixing roller biased toward the receiver; and a controller operative to control the flow of heat exchange medium through the first heating zone and through the second heating zone.

25. The fixing system of claim 22, comprising a controller operative to control flow rate of the heat exchange medium proportional to a speed at which receivers are passed through the fixing system.

26. The fixing system of claim 22, comprising a controller operative to control a temperature of the heat exchange medium dependent upon a type of receiver passed through the fixing system.

27. The fixing system of claim 22, the controller being operative to control a temperature of the heat exchange medium dependent upon a type of marking material passed through the fixing system.

* * * * *